United States Patent [19]

Dunn

[11] 3,962,753

[45] June 15, 1976

[54] METHOD OF MAKING GLASS FIBER MATS AND CONTROLLING PRESSURE DROP ACROSS WEB BY VARYING PERFORATED PLATE BENEATH WEB

[75] Inventor: John W. Dunn, Sylvania, Ohio

[73] Assignee: Owens-Corning Fiberglas Corporation, Toledo, Ohio

[22] Filed: May 6, 1974

[21] Appl. No.: 467,543

[52] U.S. Cl. ..... 19/156.3; 156/62.2; 264/4 D; 264/91; 264/121

[51] Int. Cl.[2] ..... D04H 1/00

[58] Field of Search ..... 264/121, 109, 40, 91; 19/156.3, 156.4, 155, 156; 137/625.33; 28/72.3; 156/62.2, 62.4; 425/80–83

[56] References Cited

UNITED STATES PATENTS

| | | | |
|---|---|---|---|
| 2,639,759 | 5/1953 | Simison | 264/121 |
| 2,933,100 | 4/1960 | Waterfill | 137/625.33 |
| 2,940,135 | 6/1960 | Heritage | 19/156.3 |
| 2,990,004 | 6/1961 | Sowers et al. | 19/156.3 |
| 3,158,668 | 11/1964 | Johnson | 264/121 |
| 3,256,569 | 6/1966 | Draving | 19/156.4 |
| 3,356,780 | 12/1967 | Cole | 264/121 |
| 3,787,194 | 1/1974 | Rayle et al. | 264/121 |

OTHER PUBLICATIONS

Gove et al., Webster's Third New International Dictionary, Merriam, Springfield, Mass. (1963), p. 159 relied on.

*Primary Examiner*—Willard E. Hoag
*Attorney, Agent, or Firm*—John W. Overman; Kenneth H. Wetmore; Raymond E. Scott

[57] ABSTRACT

The method disclosed herein includes moving the fibers downwardly toward a continuously moving foraminous conveyor, drawing the gas through the conveyor to deposit the fibers on the conveyor, creating a back pressure by locating an apertured plate immediately below the conveyor and collecting the fibers in a relatively static area, immediately above the conveyor.

3 Claims, 3 Drawing Figures

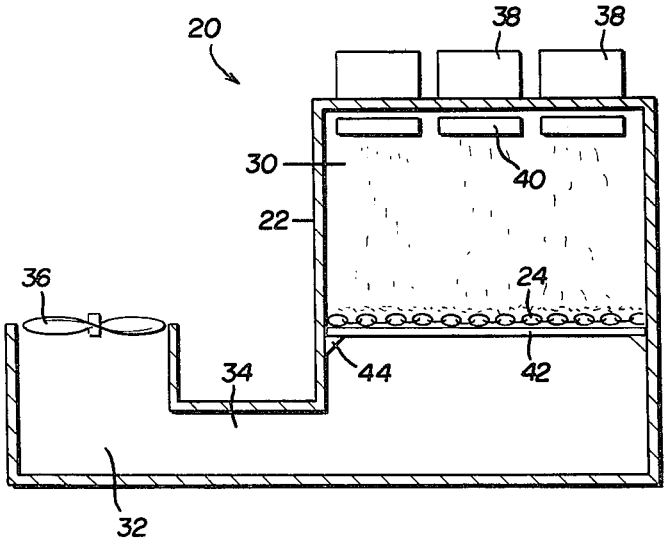
FIG. 1
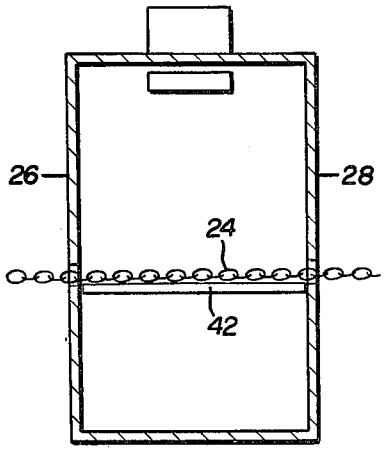
FIG. 2
FIG. 3
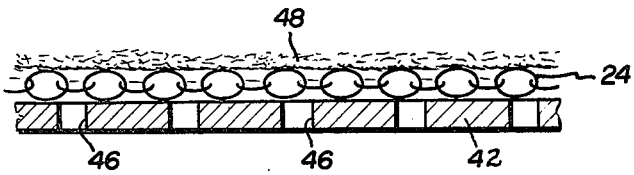
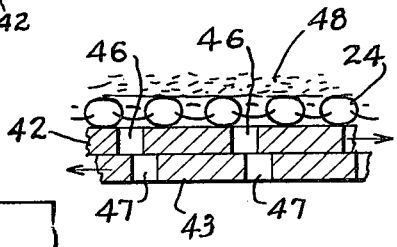
FIG. 5
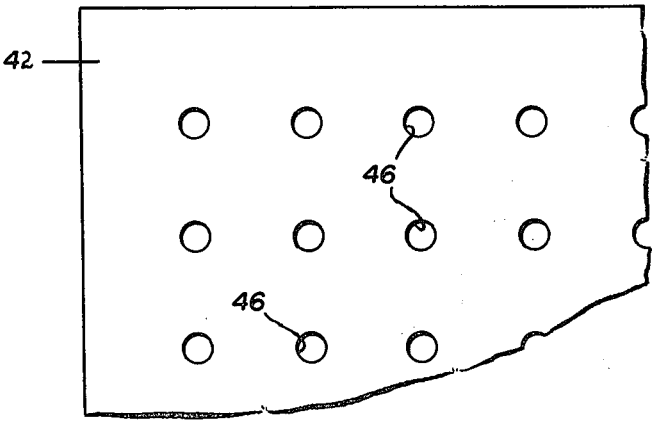
FIG. 4

METHOD OF MAKING GLASS FIBER MATS AND CONTROLLING PRESSURE DROP ACROSS WEB BY VARYING PERFORATED PLATE BENEATH WEB

BACKGROUND OF THE INVENTION

The apparatus and method of this invention concerns the production of chopped glass strand mats, particularly multilayer strand mats.

In the production of multilayer strand mats, it has been a particularly difficult problem to obtain an even distribution of the chopped glass strands in the mat. The strands may be produced in the conventional manner, such as disclosed in U.S. Pat. No. 2,719,336, assigned to the Assignee of the instant application and incorporated herein by reference. In the disclosed method, a plurality of glass strands are received in the choppers from a creel, air flow directs the streams of glass fibers in the hood and the fibers are continuously collected in the form of a mat on a foraminous conveyor chain.

The difficulty has been to provide an even distribution of the glass fibers on the conveyor because of two problems. First, the circulation of gases within the hood is difficult to control. The gas flow is generally turbulent away from the side walls of the hood and is laminar to quiescent at the side walls. In a conventional hood, more than one air inlet port may be utilized to direct the fibers in the desired patterns, however this has not solved the problem. The second problem apparently involves pressure differentials at the conveyor and immediately above the conveyor. These pressure differences cause the fibers to move or jump after deposition on the conveyor, toward low pressure areas generally adjacent the edges of the conveyor. Even if it were then possible to evenly distribute the chopped fibers on the conveyor initially, the distribution would be changed before the mat leaves the hood.

SUMMARY OF THE INVENTION

The apparatus and method of this invention solves the problem of the prior art by providing a plate or panel immediately below the conveyor, which panel includes a plurality of spaced apertures or holes. The hood includes a suction box which is continuous with the hood and includes a fan or blower which draws the air through the conveyor and the plate at a relatively high rate, such as 2000 feet per minute. The plate creates a back pressure and a relatively static high pressure area immediately above the conveyor, eliminating the problem of random movement of the fibers after deposition on the conveyor and reduces the air circulation problem, permitting an even distribution of the fibers on the mat.

In the preferred embodiment, the plate is located immediately below the conveyor and produces a relatively large pressure drop across the plate. The plate therefore preferably has less than fifty percent open area and should be located within a distance equal to one diameter of the apertures from the foraminous conveyor. In the disclosed embodiment, the holes are equidistant in the plate and are equal in diameter.

Other advantages and meritorious features of the disclosed invention will be more fully understood from the following description of the preferred embodiments and method and the drawings, a description of which follows.

DESCRIPTION OF THE DRAWINGS

FIG. 1 is a partially cross-sectioned side elevation of the apparatus of this invention;

FIG. 2 is an end view of the apparatus shown in FIG. 1;

FIG. 3 is a side cross-sectional enlarged view of the foraminous conveyor and plate shown in FIGS. 1 and 2;

FIG. 4 is a top view of the plate shown in FIG. 3; and

FIG. 5 is a side-sectional enlarged view showing a foraminous conveyor with cooperating apertured members immediately below it.

DESCRIPTION OF THE PREFERRED EMBODIMENTS

The apparatus 20 shown in FIGS. 1 and 2 includes a hood 22 and a continuous foraminous conveyor 24, such as a conventional chain conveyor. The hood 22 is substanitally enclosed, except for the openings for the conveyor and includes side walls 26, 28 and 30. The hood also includes a suction box 32 which is continuous, through channel 34, with the side walls of the conveyor. The suction box includes a blower or fan, shown schematically at 36, which draws or forces air through the foraminous conveyor 24.

In the disclosed apparatus, strands of glass fibers, not shown, are received from a creel or the like in choppers 38. The chopped glass strands are then received in the hood and directed downwardly toward the conveyor 24, by gas passing through the inlet holes or ports 40. The construction of the creel, choppers and ports are well known in the art and disclosed in the above referenced U.S. Pat. No. 2,719,336.

In the apparatus of this invention, a plate 42 is located immediately below the foraminous conveyor 24 and is supported in the hood parallel to the conveyor on suitable supports 44. As shown in FIGS. 3 and 4, the plate includes a plurality of circular apertures or holes 46 through the plate and perpendicular to its faces. The apertured plate thereby provides a substantial pressure drop across the conveyor, as will be described more fully below.

In the disclosed embodiment, the holes are spaced equidistant in the plate and define less than fifty percent of the total area of the plate. For example 3/16 inch holes on ¾ inch centers provide a sufficient pressure drop across the conveyor for the purposes of this invention. The plate should also be located from the foraminous conveyor by a distance which is less than the diameter of the apertures, as more fully described below.

In the method of this invention using the apparatus of FIGS. 1 and 2, glass strands are received in choppers 38 and moved downwardly toward the foraminous conveyor 24. As described above, the air circulation within the hood normally causes a turbulent flow spaced from the side walls 26 to 28 of the hood. The air flow adjacent the side walls is generally laminar and the air is quiescent at the side walls because of the air-wall friction, as described above.

Air is drawn in the inlet ports 40 and down through the foraminous conveyor 24 and plate 42, through holes 46, by the fan 36 in the suction box 32. The flow rate through the holes 46 is preferably relatively high, for example 2000 feet per minute.

In the preferred embodiment, the plate 42 is located parallel to the conveyor 24 a distance equal to or less than the diameter of the holes 46, creating a back pressure and a relatively static high pressure area immediately above the conveyor, where the chopped strands are deposited on the conveyor. This static pressure area eliminates the jumping or random movement of the chopped glass fibers on the conveyor after deposition and creates a quiescent high pressure area, having a lower flow rate, which aids in the distribution of the fibers on the mat. As will be understood by those skilled in the art, that air drawn through the controlable inlet ports 40 by suction from below creates a downward stream of air inside the hood that directs the fibers to the conveyor. When the fibers reach the high pressure static area immediately above the conveyor, the fibers then settle evenly on the mat.

The method and apparatus of this invention may also be utilized in other applications, such as the manufacture of curly glass fibers, as disclosed in U.S. Pat. No. 2,927,621, wherein the choppers 38 are replaced with feeders. The glass strands are then received in the hood and blowers attenuate the streams of glass into fibers which are collected on the foraminous conveyor. The method and apparatus of this invention is however particularly suitable for the manufacture of chopped fiber glass mats, wherein the chopped fibers are relatively small and subject to random redistribution after deposition on the conveyor.

FIG. 5 is similar to FIG. 3 except that there is a second apertured member for varying the air passageways through the first apertured plate 42. The second apertured plate 43 with holes 47 is movable with respect to the first apertured plate 42 having holes 46. By moving the lower member 43, a portion of the holes 46 in the upper member 42 are blocked so that the air passageways through the first plate are varied. Thus the air flow through the first member 42 is varied. The plates may be moved to cause more air flow in desired areas of the foraminous conveyor.

So it can be seen that the invention provides improvements in apparatus for producing a fibrous layer. In a broad sense, discontinuous fibers are moved to a foraminous surface to form a layer and air is drawn downwardly through the foraminous surface such that a substantially static high air pressure region is established immediately above the surface to reduce movement of the fibers in the layer after their deposition.

More specifically, discontinuous fibers are directed to a foraminous surface to form a layer. Immediately below the foraminous surface is at least one apertured member. Air is drawn downwardly through the foraminous surface and apertured member such that a substantially static high pressure air region is formed immediately above the foraminous surface to reduce movement of the fibers in the layer on the surface.

Having described the invention in detail, it will be understood that such specifications are given for the sake of explanation, and various modifications and substitutions other than those cited may be made without departing from the scope of the invention as defined in the following claims.

I claim:

1. A method of making a continuous mat of glass fibers in an enclosed hood, comprising the steps of:

a. directing the fibers downwardly within the hood toward a continuously moving foraminous conveyor, b. creating a predetermined pressure drop across the hood, below said conveyor, by locating a plate having a plurality of apertures below said conveyor, wherein the apertures in said plate define less than fifty percent of the total area of said plate, and c. continuously collecting the glass fibers on said conveyor, said pressure drop providing a relatively uniform distribution of fibers on said continuously moving foraminous conveyor.

2. The methods of making a continuous mat of glass fibers defined in claim 1, including creating a relatively high static pressure area above said conveyor by locating said plate immediately below said conveyor, and collecting said fibers within said high static pressure area, thereby reducing random movement of the glass fibers after deposition on said conveyor.

3. The method of making a continuous mat of glass fibers defined in claim 1, including controlling said pressure drop within said hood by locating two apertured plates in face to face relation below said conveyor, said apertures generally perpendicular to the confronting plate faces, and relatively laterally moving said plates to control the effective aperture area through said plates and thereby controlling said pressure drop.

* * * * *